US010330314B2

(12) United States Patent
Bertler et al.

(10) Patent No.: US 10,330,314 B2
(45) Date of Patent: Jun. 25, 2019

(54) THROTTLED DIRECT VENT TERMINATION

(71) Applicant: DuraVent, Inc., Detroit, MI (US)

(72) Inventors: Matthew L. Bertler, Vacaville, CA (US); Ryan L. Devine, Richmond, CA (US)

(73) Assignee: DuraVent, Inc., Detroit, MI (US)

( * ) Notice: Subject to any disclaimer, the term of this patent is extended or adjusted under 35 U.S.C. 154(b) by 547 days.

(21) Appl. No.: 14/603,815

(22) Filed: Jan. 23, 2015

(65) Prior Publication Data

US 2016/0215978 A1 Jul. 28, 2016

(51) Int. Cl.
*F23L 17/04* (2006.01)

(52) U.S. Cl.
CPC ..... *F23L 17/04* (2013.01)

(58) Field of Classification Search
CPC .. F23L 7/04; F16K 1/221; F16K 3/246; F16K 3/265; F16K 3/267; F16K 27/04; F16K 31/44; F16K 31/445; F16K 31/56; F16K 3/316; F24L 17/04; F24F 13/065
USPC ..... 454/8, 245, 247, 248; 126/44, 400
See application file for complete search history.

(56) References Cited

U.S. PATENT DOCUMENTS 1,912,304 A * 5/1933 Phillips ..... B67D 3/045 222/513
3,776,433 A * 12/1973 De Treitas ..... B65D 47/246 222/519
4,198,561 A * 4/1980 Fujioka ..... A47J 36/26 219/432
5,915,371 A * 6/1999 Hering ..... F24C 1/16 126/30
6,138,973 A * 10/2000 Woodward ..... A47C 3/26 248/188.5
7,753,234 B1 * 7/2010 Heiberger ..... B65D 47/243 222/153.09
2002/0096654 A1 * 7/2002 Holloway, Jr. ..... E02B 13/00 251/129.11
2009/0314274 A1 * 12/2009 Huggins ..... F24C 5/20 126/44
2010/0108052 A1 * 5/2010 Jacklich ..... F23J 13/025 126/80

* cited by examiner

*Primary Examiner* — Steven B McAllister
*Assistant Examiner* — Allen R Schult
(74) *Attorney, Agent, or Firm* — Howard & Howard Attorneys PLLC

(57) ABSTRACT

A throttled vent termination or cap for use in conjunction with a direct vent appliance and venting system is provided. The direct vent termination includes an inner pipe and a concentric outer housing surrounding the inner pipe to form a void between the inner pipe and the outer housing. The void adapted to provide intake air to the air intake section of the vent system. An end cap is provided at a first end of the outer pipe, the inner pipe to the end cap and having an exhaust opening therein. An intake region is formed in the outer housing providing access to the void. A throttle cover which is configured to be movably positioned and thereafter secured at one of a number of positions over the intake region using a throttle guide is provided to thereby regulate air flow into the void.

15 Claims, 5 Drawing Sheets

THROTTLED DIRECT VENT TERMINATION

BACKGROUND

Direct vent gas stoves and fireplaces are appliances that use a flue to vent combustion waste outside of a dwelling. Venting can occur either horizontally, through a wall, generally referred to as a rear vent, or up through the ceiling, generally referred to as a top vent. The key advantage to direct vent appliances is that they are independent of room air and use externally sourced air for combustion.

In direct venting, room air is not used for combustion. Rather, air used for combustion is drawn into the combustion chamber by use of a conduit which communicates with the outside ambient air. Typically, a direct vent pipe includes two ducts formed by an inner pipe surrounded by a larger diameter outer pipe. The outer pipe conveys outside air to the combustion chamber. After combustion, the exhaust is conveyed to the outside via the inner pipe. The two ducts are typically cylindrical and can be concentric, with the inlet air being conducted to the combustion chamber through an annulus outside the exhaust duct and the exhaust being conducted outside by way of the inner duct, co-linear (or side-by-side), or completely separate ducts.

Vent caps cover the inlet/outlet of the first and second ducts on the outside of a dwelling. Winds and drafts around the vent cap can affect the backpressure in the duct. If there is backpressure present in the exit duct, the draw of inlet air will be reduced which will decrease combustion efficiency and can lead, in poorly designed systems, to extinguishing the combustion flame.

SUMMARY

The technology includes a throttled vent termination or cap for use in conjunction with a direct vent appliance and venting system is provided. A throttle setting can be set during initial installation and if necessary changed at any time subsequent to installation. In one embodiment, the direct vent termination includes a cylindrical inner pipe and a cylindrical concentric outer housing surrounding the inner pipe to form a void between the inner pipe and the outer housing. The void is adapted to provide intake air to the air intake section of the vent system. An end cap is provided at a first end of the outer pipe, the inner pipe passing to the end cap and having an exhaust opening therein. An intake region is formed in the outer housing providing access to the void. A throttle cover which is configured to be movably positioned and thereafter secured at one of a number of positions over the intake region using a throttle guide is provided to thereby regulate air flow into the void.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

A unique termination system including a throttling vent cap for use in conjunction with a direct vent appliance and venting system is provided. The throttling vent cap may be used as a horizontal termination on the exterior of a building and allows independent regulation of combustion air provided to a direct vent appliance. A throttle setting can be set during initial installation and if necessary changed at any time subsequent to installation.

Numerous embodiments of the vent cap of the present technology are disclosed. It will be recognized that various combinations of components of each embodiment may be substituted for components disclosed with other embodiments, providing numerous variations of the cap, all of which are intended to be within the scope of the attached claims.

FIGS. 1-4B show a first embodiment of the vent cap present technology. A vent cap assembly 100 includes a vent cap 105 shown in FIGS. 1-4B is advantageously used in conjunction with a two duct, direct vent pipe coupled to a direct vent appliance.

Figure 1B:
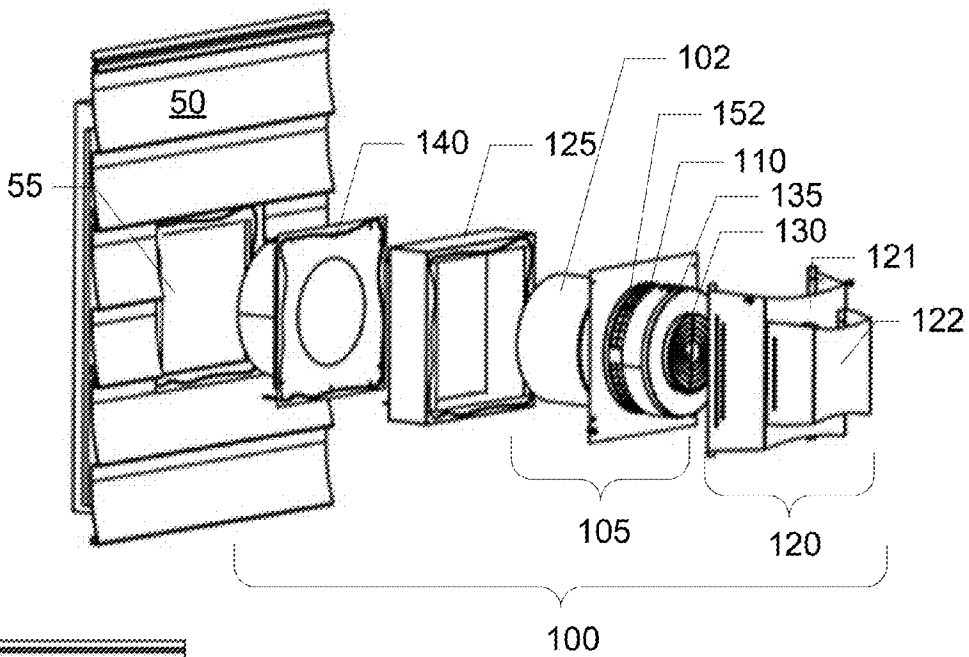
FIG. 1B is an exploded view of the direct vent termination system of FIG. 1.
Figure 1A:
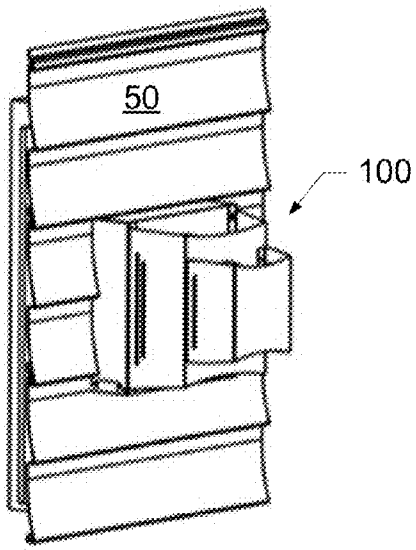
FIG. 1A depicts a perspective, view of a direct vent termination system
Figure 1C:
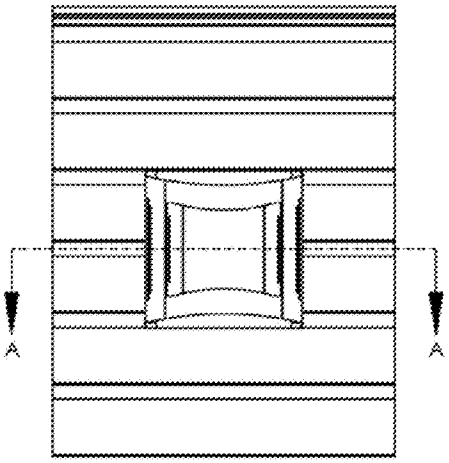
FIG. 1C is a front view of the direct vent termination system.
Figure 2:
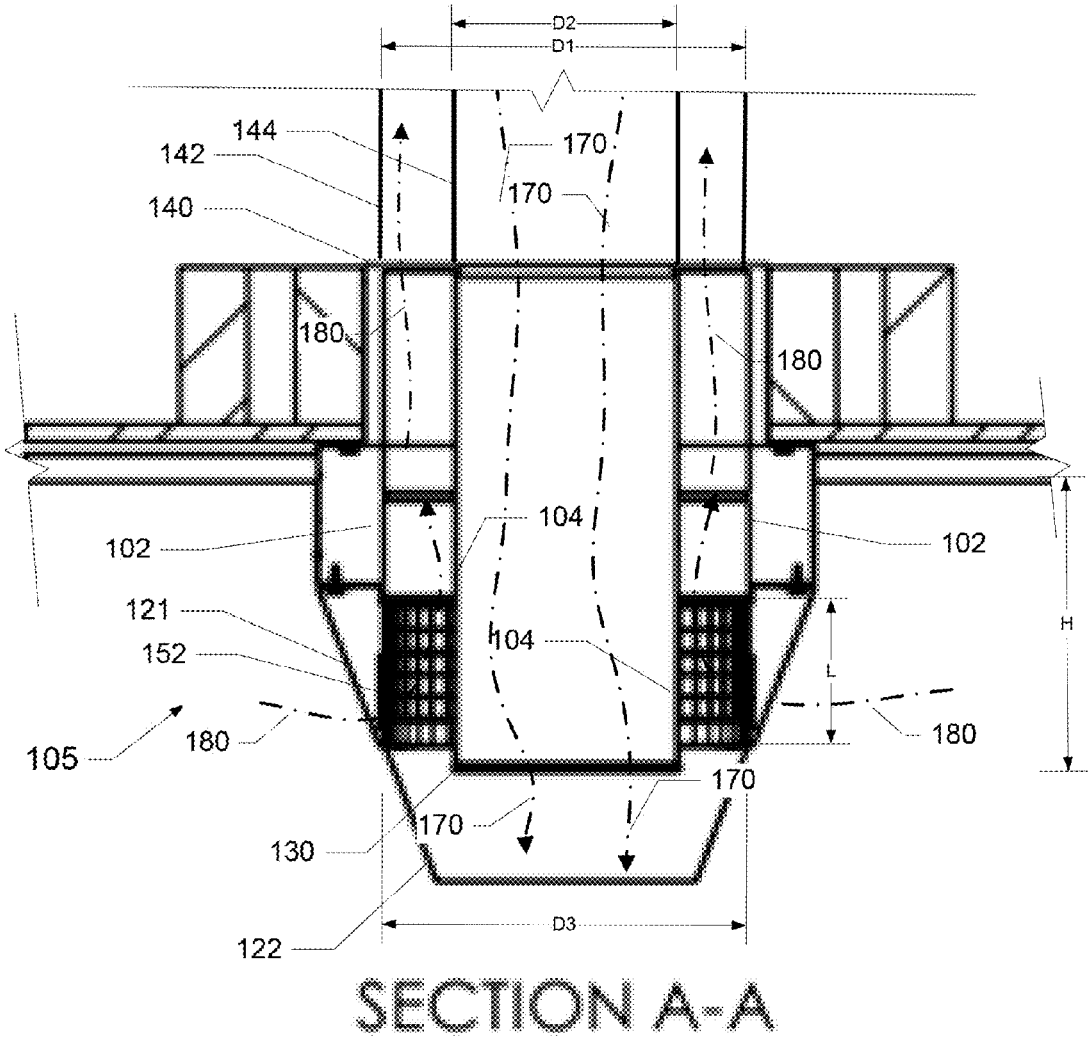
FIG. 2 is a top, cutaway view of the direct vent termination system along line A-A in FIG. 1C.
Figure 5:
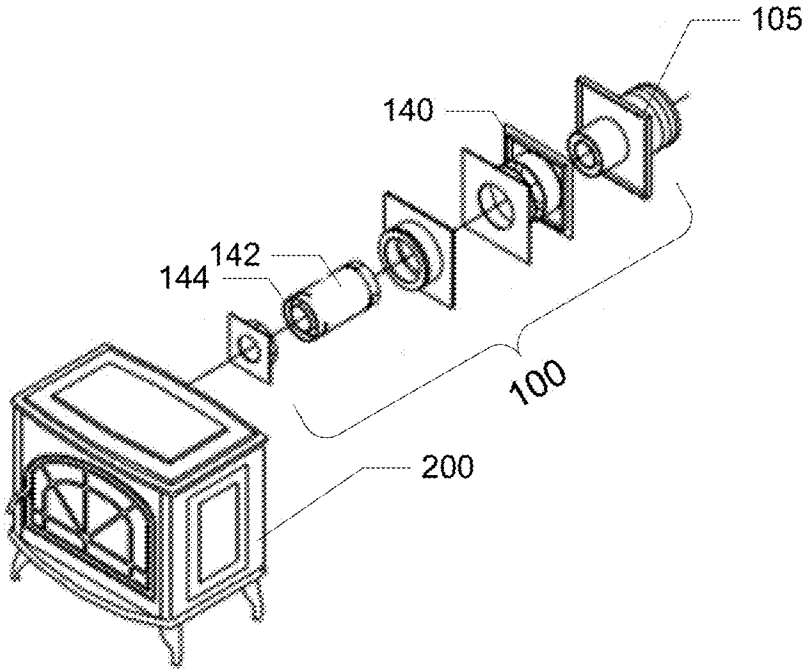
FIG. 5 is a perspective view of an appliance/vent system suitable for use with the end cap of the present technology.

With reference to FIGS. 1 and 2, vent cap 105 includes an outer cylindrical housing 102 adapted to fit into a wall opening 55 in a building wall 50. Cap 105 is mounted to the exterior of the building wall 50. The vent cap 105 serves as the termination of a ventilation system 250 connecting the cap or termination 105 to an appliance 200, such as that shown in FIG. 5. The particular nature of the venting system is not critical to the present technology, but comprises a direct vent system. A direct vent system comprises a system designed and built to exhaust gas burning appliances where the venting system comprises a sealed and balanced system with an air intake and exhaust designed into the venting. This type of venting system is a component of the appliance manufacturer's listed system.

The vent cap 105 is designed to be mounted to the exterior wall 50 of a building. The cap is mounted to the exterior by passing the housing 102 optionally though a stand-off box 125 and through the opening 55. A wall thimble 140 may be used around the vent system as it passes through the wall.

An outer cover 120 having a first partially trapezoidal housing 121 and an second, standoff section 122 (when viewed from the top or bottom as illustrated in FIG. 2) is coupled by fasteners or other suitable fastening means to wall 50 or a standoff box 125. It will be recognized by one of average skill that alternatives exist for coupling the cover 120 to the termination system and any number of different cover shapes and styles (or no cover) may be utilized with the end cap 105.

A direct vent pipe is formed by an outer housing 142 and inner exhaust pipe section 144, which is coupled to corresponding pipe sections 102 and 104 in the vent cap 105. An end cap 135 allows the inner pipe section 104 to pass completely through the outer pipe section to exhaust opening 130. Spacers (not shown) may be provided between inner pipe section 104 and outer housing 102 to secure the sections to each other. The pipe sections are designed to couple to a direct vent pipe in a well-known manner. For example, the outer sleeve may include ridges to allow the pipe coupling to engage a twist lock coupling such as that commercially available from M&G DuraVent Corporation, which is a bayonet-style lock allowing on end of the vent pipe to be inserted into the inner and outer pipes of the cap 105 and twisted into place to secure it therein.

Where pipe section 142 is cylindrical, it has a diameter D1 which provides a perimeter P1 (in this case a circumference) of $\pi$*D1 and a cross-section having an area A1=($\pi$*(½D1)$^2$). Likewise the exhaust conduit pipe section 144 when cylindrical has a diameter D2, provides a perimeter (in this case a circumference) of P2=$\pi$*D2 and a cross-section having an area A2=($\pi$*(½D2)$^2$. Other shapes of pipe section 144 and wall 102 may have different cross-sectional areas, with all having a perimeter and a cross-sectional area.

The inner sleeve 104 and outer sleeve 102 are sized relative to the size of the connection to be made. Direct Vent Pipe such as that commercially available from M&G DuraVent Company, Vacaville, Calif., is suitable for use with the present technology. Numerous sizes of direct vent pipe exist. Typical sizes are 3"×4.625" (so called "3×4" pipe) 4"×6.625"" (often referred to as "4×6" pipe), and 5"×8, " referring to the diameter of the inner pipe and the outer pipe, respectively. The technology is not limited by the type or size of pipe coupled to the vent cap.

As illustrated in FIGS. 2 and 3A-3C, exhaust flow 170 travels from the appliance through the inner pipe to an exhaust opening 130. Exhaust opening 130 is covered by a screen. Intake air 180 for the appliance travels in the annular space (a void) between the outer pipe section 102 and inner pipe section 104 to a corresponding annular space formed in the venting system components (for example between pipes 142 and 144) from the vent cap 105 to the appliance to provide combustion air.

As illustrated in FIGS. 1-4, an intake throttle cover 110 is provided on the vent cap 105. Apertures, which in one embodiment comprise a mesh screened section 152 having a length L, are provided in outer housing 102 to allow intake air 180 into the venting system. Due to the position of the exhaust housing relative to the air intake area in the meshed screened section 152, little mixing of the exhaust flow 170 and the intake air 180 occurs. The apertures have an area A3 of $\pi$(D3)*L. In one embodiment, the unrestricted (uncovered) area of the apertures 152 is at least 35% of the cross-sectional area of the exhaust conduit, outer pipe section 102.

A throttle cover 110 is provided. Where the outer pipe 102 is cylindrical, the throttle cover may be a cylindrical ring having a circumference greater than a circumference of outer pipe housing 102 allowing the cover 110 to be slid vertically in the direction of arrow 112 in FIG. 3A to regulate intake flow for combustion air 180 into the appliance. A throttle guide 115 is formed in the throttle cover 110 and engages a pin 116 formed in the exterior housing 102 of the cap 105. In one embodiment, the throttle guide takes the form of a slotted ladder having a horizontal center section or slot and any number of rotational slots (in this case, four) to engage pin 116. By rotating the cylindrical cover 110, the pin 116 attached to housing 102 may be rotated to a center section of the guide 115 to allow for movement in the direction of arrow 112. Once a suitable airflow setting has been achieved, the cover 110 is rotated so that pin 116 engages one of four rotational setting slots (1-4 in FIG. 4*b*) to provide the regulated intake airflow.

The throttle cover can be constructed to cover a variable amount of the unrestricted area of the apertures, in a range of no covering to less than 100 percent covering.

Figure 3A:
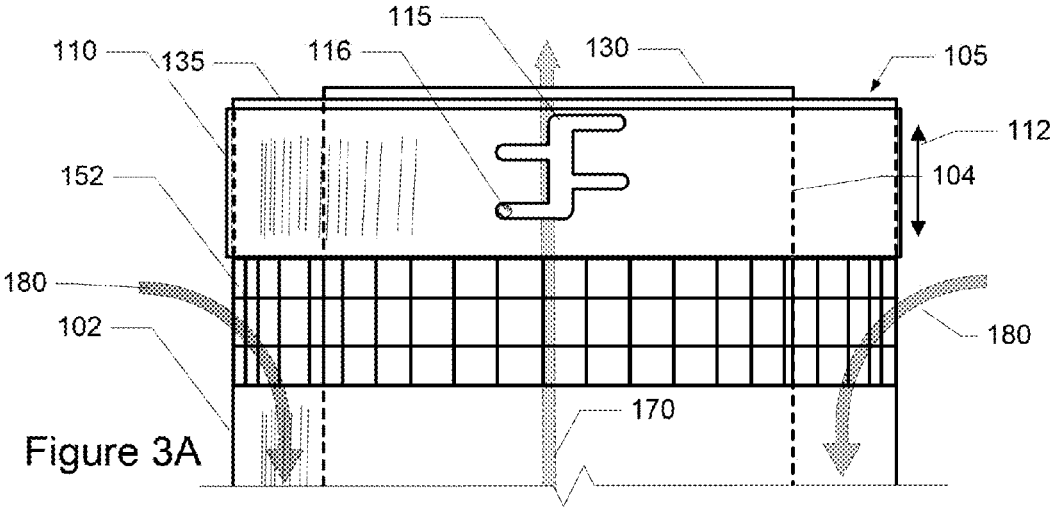
FIGS. 3A-3C are top views of an air intake and throttle system for the termination of FIG. 1 illustrating the throttle in various states.
Figure 3B:
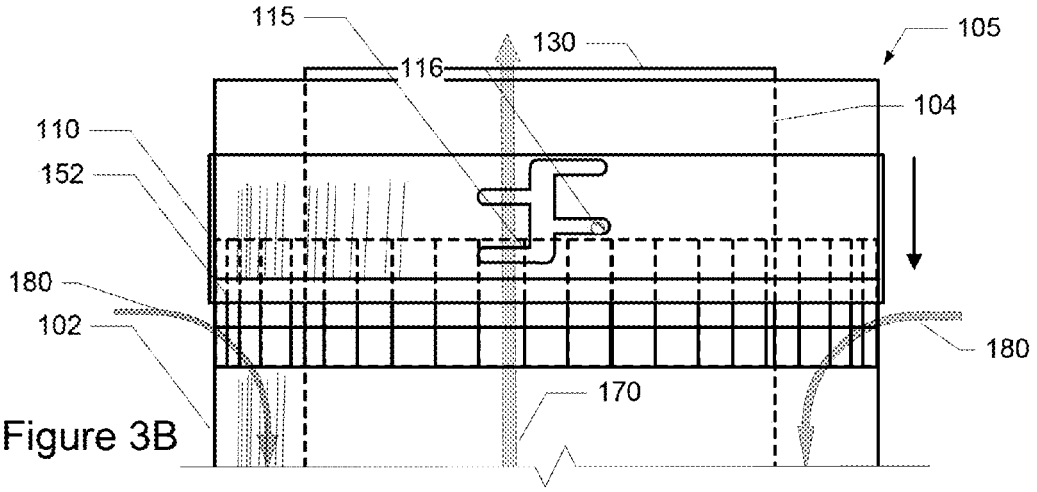
Figure 3C:
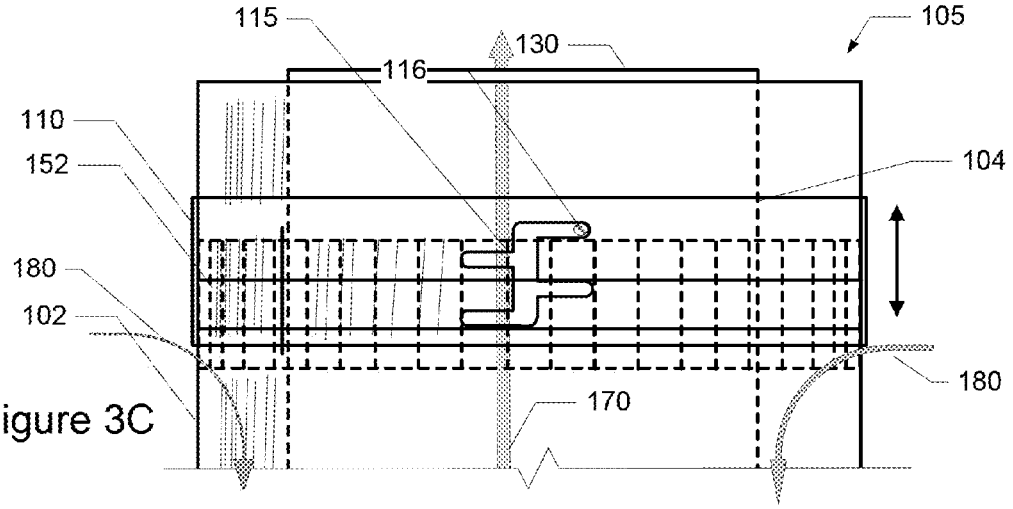
Figures 4A, 4B:
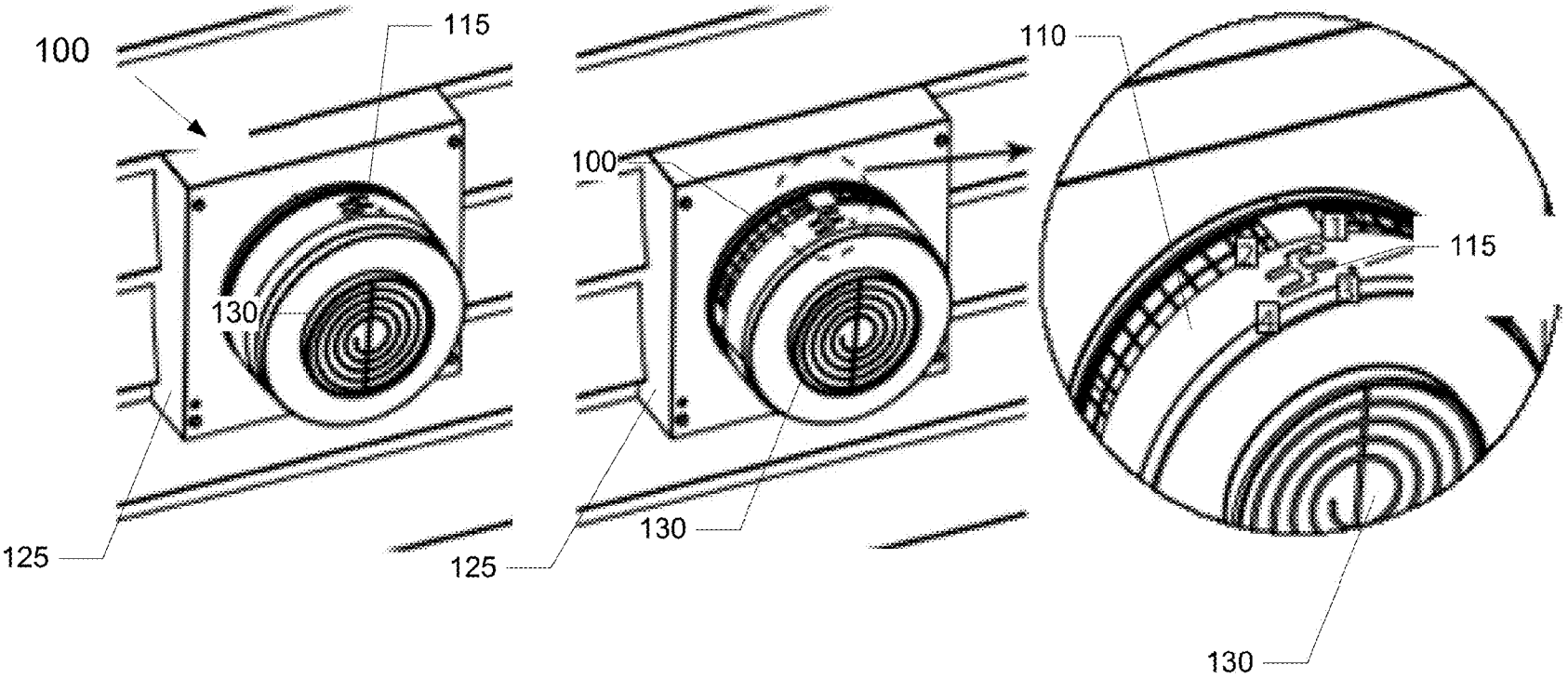
FIG. 4A is a perspective view of the air intake and throttle in the position shown in FIG. 3A-3C.
FIG. 4B is a detail view of the air intake and throttle shown in FIG. 4A.

FIGS. 3A-3C illustrate various settings: setting 1 (FIG. 3A) at fully open; setting 2 (FIG. 3B) and Setting 4 in FIG. 3D; each of settings 2-4 leads to progressive levels of restriction. It should be understood that more or fewer settings may be provided in the throttle. In the FIGS. 3A-3C, the relative amount of intake flow 180 is reduced by increased throttle restriction. Setting 4 is restricted, but not fully sealed.

In one embodiment the total unrestricted area of the aperture is at least 35% of the cross sectional area of the exhaust conduit. In one embodiment, the throttle cover 110 is capable of being adjusted to occlude at least half ½of the area of the apertures and optionally, at least 10% of the area of the apertures.

As illustrated in FIG. 1A, the vent cap 104 is mounted on a planar surface (wall 50) and the exhaust opening 130 is positioned a distance H from the plane to the nearest part of the exhaust opening, which is no greater than 1.5 times the perimeter of the exhaust port or opening 130.

As noted above, the direct vent system (including pipe sections 142, 144) has a diameter and a perimeter. Vent cap 105 also has a diameter D3, and a perimeter defined in terms of the diameter (or other parameters depending on the shape of the vent cap 105). In one embodiment, the vent cap has a perimeter of an outer housing that is less than 3 times the perimeter of the outer pipe 142 of the direct vent system to which it is connected. In one embodiment the vent cap has a perimeter of an outer housing that is equal to the perimeter of the outer pipe 142 of the direct vent system to which it is connected.

Vent cap 105 provides a number of advantages over the prior art. In particular, the throttle cover 110 allows tailoring of the combustion air intake based on the particulars of the installation and the appliance used. In particularly windy conditions, the intake can be reduced if needed. The specific values of L, H, the relationship between P1 and P3, and the relationship between A3 and A2 have been empirically determined to be drivers to system performance.

It should be further understood that while the cap 105 is formed of cylindrical pipe sections, the teachings herein are not limited to cylindrical end caps—any shaped cap—square, rectangular, hexagonal, etc.—may incorporate the teachings of the throttling mechanism disclosed herein.

In yet another embodiment of the technology, the cap 105 may be used with a wall thimble, vinyl siding standoff (VSS), optional vent insulation, etc. For installations requiring a vertical rise on the exterior of the building, snorkel terminations may be utilized with the same general installation procedures as used for a horizontal termination illustrated herein.

Additional Aspects of the Technology

Embodiments of the present technology include a termination for a direct vent system, communicating with an appliance, the system having an exhaust section and an air intake section. The embodiments include a vent cap having an inner exhaust conduit and an outer housing, with a void formed between the inner conduit and the outer housing, the void coupled to the air intake section; one or more apertures communicating with the void; and a throttle cover configured to regulate air flow through the apertures into the void.

Embodiments of the technology include the aforementioned embodiment wherein the apertures are formed into the outer housing.

Embodiments of the technology include any of the aforementioned embodiments wherein the inner exhaust conduit and outer housing comprise cylindrical pipes, the inner exhaust conduit having a smaller diameter than the outer housing.

Embodiments of the technology include any of the aforementioned embodiments wherein the outer housing has a first end and a second end, and a length, the inner exhaust conduit having a length extending beyond the first end of the outer housing and including an exhaust opening.

Embodiments of the technology include any of the aforementioned embodiments wherein a total unrestricted area of the aperture is at least 35% of a cross sectional area of the exhaust conduit.

Embodiments of the technology include any of the aforementioned embodiments wherein the throttle cover is configured to be capable of being adjusted to occlude at least 10 percent of an area of the apertures.

Embodiments of the technology include any of the aforementioned embodiments wherein the throttle cover includes a throttle guide configured to set a position of the throttle cover.

Embodiments of the technology include any of the aforementioned embodiments the throttle guide includes a slotted ladder having a center slot and one or more rotational slots configured to set a position of the throttle cover.

Embodiments of the technology include any of the aforementioned embodiments wherein the termination is mounted on a planar surface, and a distance from the planar surface to a nearest portion of an exhaust opening is no greater than 1.5 times a perimeter of the exhaust opening.

Embodiments of the technology include any of the aforementioned embodiments wherein the outer housing has a perimeter less than three times a perimeter of a direct vent system to which the outer housing is connected.

Embodiments of the technology include any of the aforementioned embodiments comprising horizontal direct vent termination for a vent system, the vent system having an exhaust section and an air intake section coupled to the termination. In these embodiments, a termination comprises an inner pipe and an outer housing, with a void formed between the inner pipe and the outer housing, the inner pipe having an exhaust region, the inner pipe and outer housing coupled to the vent system; an end cap at a first end of the outer housing, the exhaust region passing through the end cap to an exhaust opening; an intake region formed in the outer housing providing access to the void, the intake region formed a distance apart from the exhaust opening; and a throttle cover positioned to variably cover the intake region to thereby regulate air flow into the void.

Embodiments of the technology include any of the aforementioned embodiments wherein a total unrestricted area of the intake region is at least 35% of a cross sectional area of the exhaust region.

Embodiments of the technology include any of the aforementioned embodiments wherein the throttle cover is configured to be capable of being adjusted to occlude at least 10 percent of the area of the intake region.

Embodiments of the technology include any of the aforementioned embodiments wherein the termination is mounted on a planar surface, and a distance from the planar surface to a nearest portion of the exhaust opening is no greater than 1.5 times a perimeter of the exhaust opening.

Embodiments of the technology include any of the aforementioned embodiments wherein the outer housing has a perimeter less than three times the perimeter total cross sectional area of a connection of a direct vent system to which it is connected.

Embodiments of the technology include any of the aforementioned embodiments wherein the inner pipe and outer housing comprise concentric cylindrical pipes, the inner pipe having a smaller diameter than the outer housing, and wherein the throttle cover comprises a cylindrical ring on the outer pipe.

Embodiments of the technology include any of the aforementioned embodiments comprising a direct vent termination for a vent system, the vent system having an exhaust section and an air intake section coupled to the termination. In these embodiments, the termination comprises a cylindrical inner pipe and a cylindrical concentric outer pipe surrounding the inner pipe to form a void between the inner pipe and the outer housing, the void adapted to provide intake are to the air intake section of the vent system; an end cap at a first end of the outer pipe, the inner pipe passing through the end cap and having an exhaust opening therein; an intake region formed in the outer pipe providing access to the void; and a throttle cover configured to be movably positioned and thereafter secured at one of a number of positions over the intake region using a throttle guide to thereby regulate air flow into the void.

Embodiments of the technology include any of the aforementioned embodiments wherein a total unrestricted area of the intake region is at least 35% of a cross sectional area of the outer pipe.

Embodiments of the technology include any of the aforementioned embodiments wherein the throttle cover is adjustable to occlude at least 10 percent of an area of the intake region.

Embodiments of the technology include any of the aforementioned embodiments wherein the termination is mounted on a planar surface, and a distance from the planar surface to a nearest portion of the exhaust opening is no greater than 1.5 times a perimeter of the exhaust opening.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A termination for a direct vent system, communicating with an appliance, the system having an exhaust section and an air intake section, the termination comprising:

a vent cap having an inner exhaust conduit and an outer housing, with a void formed between the inner exhaust conduit and the outer housing, the void coupled to the air intake section;

one or more apertures having a closed periphery in the outer housing communicating with the void, wherein a total unrestricted area of the one or more apertures is at least 35% of a cross sectional area of the inner exhaust conduit; and a throttle cover on the outer housing and configured to regulate air flow through the one or more apertures into the void by being positioned at one of a plurality of positions partially covering the one or more apertures, each of the plurality of positions providing a different level of air restriction over the one or more apertures, said throttle cover including a throttle guide with a slotted ladder having a center slot and three or more additional slots configured to set a position of the throttle cover with a pin engaging the center slot, each additional slot comprising one of the plurality of positions, each one of the positions restricting air flow to a predetermined, different level such that at least two of the positions occlude at least 10% of an area of the one or more apertures wherein the center slot is further defined as a slot in a first direction and the three or more additional slots are further defined as three or more slots in a second direction, wherein the second direction is different than the first direction.

2. The termination of claim 1, wherein the one or more apertures are formed into the outer housing.

3. The termination of claim 1 wherein the inner exhaust conduit and outer housing comprise cylindrical pipes, the inner exhaust conduit having a smaller diameter than the outer housing.

4. The termination of claim 3 wherein the outer housing has a first end and a second end, and a length, the inner exhaust conduit having a length extending beyond the first end of the outer housing and including an exhaust opening.

5. The termination of claim 1, wherein one of the plurality of positions occludes at least 10 percent of the area of the one or more apertures, and at least one different position occludes at least 50% of the area of the one or more apertures.

6. The termination of claim 1 wherein the termination is mounted on a planar surface, and a distance from the planar surface to a nearest portion of an exhaust opening is no greater than 1.5 times a perimeter of the exhaust opening.

7. The termination of claim 1, wherein the outer housing has a perimeter less than three times a perimeter of a direct vent system to which the outer housing is connected.

8. A horizontal direct vent termination for a vent system, the vent system having an exhaust section and an air intake section coupled to the termination, the termination comprising:

an inner pipe and an outer housing, with a void formed between the inner pipe and the outer housing, the inner pipe having an exhaust region, the inner pipe and outer housing coupled to the vent system;

an end cap at a first end of the outer housing, the exhaust region passing through the end cap to an exhaust opening;

an intake region including one or more apertures having a closed periphery formed in the outer housing providing access to the void, the intake region formed a distance apart from the exhaust opening; and a throttle cover positioned on the outer housing to variably cover the intake region by being slidably positioned with a throttle guide at one of a plurality of positions partially covering the intake region, each of the plurality of positions providing a different level of air restriction over the intake region to thereby regulate air flow into the void, wherein said throttle guide comprises a slotted ladder having a center slot and three or more additional slots configured to set a position of the throttle cover with a pin engaging the center slot, each additional slot comprising one of the plurality of positions, wherein the center slot is further defined as a slot in a first direction and the three or more additional slots are further defined as three or more slots in a second direction, wherein the second direction is different than the first direction wherein the plurality of positions includes a first position where a total unrestricted area of the intake region is at least 35% of a cross sectional area of the exhaust region, and wherein the plurality of positions includes at least two different positions which occlude at least 10 percent of the unrestricted area of the intake region.

9. The termination of claim 8 wherein the plurality of positions includes one position in which the throttle cover occludes at least 10 percent of the unrestricted area of the intake region, and includes another position in which the throttle cover occludes at least 50 percent of the unrestricted area of the intake region.

10. The termination of claim 9 wherein the termination is mounted on a planar surface, and a distance from the planar surface to a nearest portion of the exhaust opening is no greater than 1.5 times a perimeter of the exhaust opening.

11. The termination of claim 10 wherein the outer housing has a perimeter less than three times the perimeter total cross sectional area of a connection of a direct vent system to which it is connected.

12. The termination of claim 11 wherein the inner pipe and outer housing comprise concentric cylindrical pipes, the inner pipe having a smaller diameter than the outer housing, the throttle cover comprises a cylindrical ring on the outer pipe.

13. A direct vent termination for a vent system, the vent system having an exhaust section and an air intake section coupled to the termination, the termination comprising:

a cylindrical inner pipe and a cylindrical concentric outer pipe surrounding the inner pipe to form a void between the inner pipe and the outer housing, the void adapted to provide intake are to the air intake section of the vent system;

an end cap at a first end of the outer pipe, the inner pipe passing through the end cap and having an exhaust opening therein;

an intake region formed in the outer pipe providing access to the void; and a throttle cover substantially free of apertures configured to be movably positioned and thereafter secured at one of a number of positions partially covering the intake region, each of the number of positions providing a different level of air restriction over the intake region using a throttle guide to thereby regulate air flow into the void, wherein said throttle guide comprises a slotted ladder having a center slot and three or more additional slots configured to set a position of the throttle cover with a pin engaging the center slot, each additional slot comprising one of the plurality of positions, wherein the center slot is further defined as a slot in a first direction and the three or more additional slots are further defined as three or more slots in a second direction, wherein the second direction is different than the first direction wherein the plurality of positions includes a first position where a total unrestricted area of the intake region is at least 35% of a cross sectional area of the exhaust region, and wherein the plurality of positions includes at least two different positions which occlude at least 10 percent of the unrestricted area of the intake region.

14. The termination of claim 13 wherein the plurality of positions includes one position in which the throttle cover occludes at least 10 percent of the unrestricted area of the intake region, and includes another position in which the throttle cover occludes at least 50 percent of the unrestricted area of the intake region.

15. The termination of claim 13 wherein the termination is mounted on a planar surface, and a distance from the planar surface to a nearest portion of the exhaust opening is no greater than 1.5 times a perimeter of the exhaust opening.

* * * * *